United States Patent [19]

Perkinson

[11] 3,941,286

[45] Mar. 2, 1976

[54] ONE-HANDED SERVING TRAY

[76] Inventor: John W. Perkinson, 2104 Forresthill Road, Alexandria, Va. 22307

[22] Filed: June 4, 1975

[21] Appl. No.: 583,561

Related U.S. Application Data

[63] Continuation-in-part of Ser. No. 513,067, Oct. 8, 1974, abandoned.

[52] U.S. Cl. ..... 224/48 C; 206/72; 294/1 R; 294/25

[51] Int. Cl.[2] ..... A47G 23/06

[58] Field of Search ..... 294/1 R, 7, 3.5, 25, 32, 294/55; D7/23, 37, 38, 39; 206/1.7, 1.8, 72; 224/45 R, 45 G, 46 R, 46 T, 48 R, 48 A, 48 C, 48 D, 48 E; 229/28 R, 28 BC, 30

[56] References Cited

UNITED STATES PATENTS

| | | | |
|---|---|---|---|
| 2,466,636 | 4/1949 | Bruckner et al. | 224/48 C |
| 3,162,344 | 12/1964 | Sabol | 224/48 C |
| 3,315,858 | 4/1967 | Horner | 224/48 A |
| 3,504,832 | 4/1970 | Corvetti | 206/72 X |
| R27,688 | 6/1973 | White et al. | 224/48 R |

*Primary Examiner*—John J. Love
*Assistant Examiner*—Johnny D. Cherry
*Attorney, Agent, or Firm*—Gerald K. White

[57] ABSTRACT

A serving tray, having an opening through which at least a portion of the server's hand may be inserted and a support which thrusts upwardly against the wrist and/or forearm materially assists in carrying and balancing the laden tray, has utility for use in situations in which the server must carry and serve from the tray with one hand.

16 Claims, 3 Drawing Figures

ONE-HANDED SERVING TRAY

This application is a continuation-in-part of copending application Ser. No. 513,067, entitled "One-Handed Serving Tray," and filed on Oct. 8, 1974 and now abandoned.

My invention is generally premised upon the discovery that a serving tray may be designed in such a manner that the server is able to carry heavily laden trays in a balanced manner with use of only one hand. The ability to carry heavy loads with one hand both facilitates serving and reduces muscular fatigue. Moreover, the tray is easily balanced, thus, minimizing potential spillage.

The prior art has attempted to provide a solution to this problem by various manners. Illustrative of such attempts are U.S. Pat. Nos. 219,183, Re. Nos. 27,688, 2,100,542, and 2,295,860. However, these inventions, for reasons which will become apparent, simply do not provide support in accordance with the principle of my invention.

It is thus, an object of my invention to provide a serving tray that may be carried and balanced in one hand and is capable of carrying relatively heavy loads.

It is further objective to provide a tray that is readily stackable or nestable with like trays so as to facilitate storage.

It is yet another objective, to provide a one-handed serving tray that may be placed on a flat surface without tilting.

These and additional objectives and advantages of my invention will be apparent to those skilled in the art from the following description of the invention.

The normal mode of carrying a serving tray with one hand is to place the thumb on the top surface of the tray and to place the palm of the hand and fingers under the tray to support the weight of the tray. By carrying a tray in the above described manner, the hand of the server becomes easily fatigued because primarily only hand muscles are involved in carrying the tray. Muscular fatigue is largely eliminated by using the serving tray of the invention.

The inventive serving tray is structured in such a manner that the server is enabled to use the forearm and/or wrist to assist the hand in supporting and balancing the tray. This procedure enables the server to more easily bear the weight of the tray and its contents. The improved effect is obtained by permitting the fingers and at least a portion of the palm of the hand to serve as a fulcrum with the weight of the tray being balanced by an upward thrust of the tray directed upon the forearm and/or wrist of the server. Hence, the weight of the tray and its contents is more evenly distributed along the entire arm.

The tray of the invention may be advantageously employed under conditions where the server must rapidly move through a crowded or otherwise congested area, because lateral movement of the tray is controlled by lateral movement of the arm since the tray is essentially an extension of the arm.

The tray may be also carried in the normal two-handed manner until the moment at which a free hand is required for serving. At this time, the tray can be easily shifted to a position where the forearm is used to assist in supporting the laden tray. This procedure frees the other hand for serving.

Figure 1:
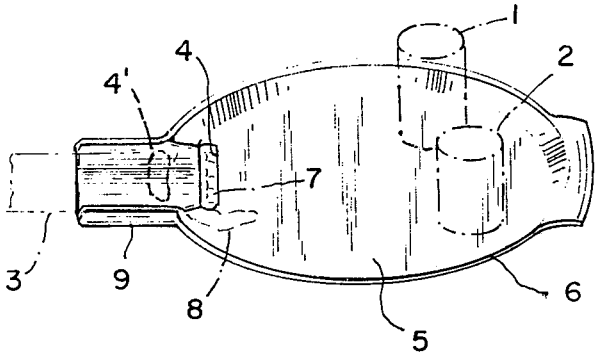
FIG. 1 is a perspective view of the serving tray of the invention.

FIG. 1 illustrates an embodiment of the invention that is preferred from the standpoint that it may be manufactured as a simple, one piece unit and is nestable or stackable with like trays during storage. The serving tray is generally planar and has a top surface 5 and a bottom surface. Top surface 5 is adapted to hold objects 1 and 2. Rim 6 partially follows the periphery of the tray and is raised so as to assist in the prevention of spillage of the carried items. Opening 4 extends through the top and bottom surfaces of the tray and is dimensioned so that a portion of the server's hand may be extended through the opening. The tray is supported at its bottom by the fingers and at least a portion of the palm of the hand when the server's hand and forearm are positioned to be generally coplanar with the top and bottom surfaces of the tray. The opening may be located at or proximate to either side of the periphery of the tray as illustrated by openings 4 and 4', so as to maximize the effective carrying area of the tray. Of course, the opening could be located nearer to the center portion of the tray in order to increase the ease of tray support. It should be further understood that the term periphery, when used in the context of the invention, refers to the area bounding the edge of the major portion of the serving tray and includes an imaginary line that would complete the symmetry of such boundry even though a portion of the tray protrudes beyond the imaginary line.

Although not essential to the operability of the invention FIG. 1 illustrates a preferred mode of hand insertion. Fingers 7 and a portion of the palm are placed upon the tray bottom and thumb 8 is rested upon the tray top. Such technique permits thumb 8 to assist in gripping and preventing torsional movement of the tray. Support means 9 comprise a semi-cylindrical extension of the tray that is integral with the carrying portion of the serving tray. The support means is generally parallel to the top and bottom planar surfaces and extend beyond the tray periphery and is located at a position below the bottom surface of the tray. The support means is preferably shaped to conform to the server's wrist and/or underside of forearm and wrist 3. When objects 1 and 2 are placed on the serving tray, support means 9 is thrust against the underside of the server's wrist and/or forearm. Such balancing of forces serves to effectively distribute the weight of the tray and its contents over the server's hand and forearm; thus, reducing the amount of weight that must be supported by hand.

Figure 2:
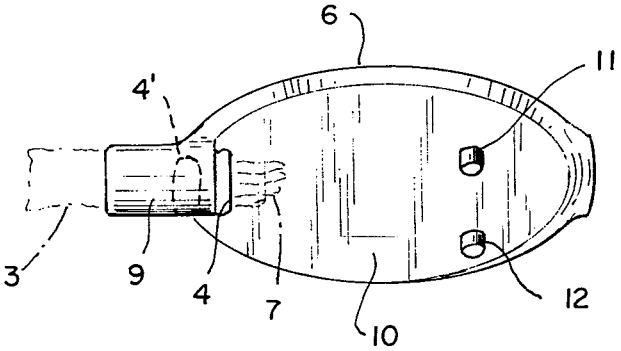
FIG. 2 is another perspective view of the serving tray of the invention.

FIG. 2 illustrates the same tray from a different perspective. This view further depicts the positioning of fingers 4 on tray bottom 10 as well as the manner in which support means 9 are thrust against the underside of the server's forearm and wrist 3. Legs 11 and 12, in combination with support 9, form a tripod type of understructure which permits the server to rest the tray on a generally level surface without encountering tilting. Obviously, legs 11 and 12 should be extended approximately the same distance below tray bottom 10 as that of support means 9.

Support means 9 should be of such a length so as to be adapted to be thrust against the underside of the server's wrist and/or forearm. By increasing the length of the support means so that it is thrust against the forearm as well as the wrist, a greater degree support may be obtained. Such procedure would facilitate the carrying of relatively heavy trays and loads. This effect is also a function of the location of opening 4. As would be apparent to those skilled in the art, the support means length and opening location could be varied so as to produce whatever combination of weight distribution and effective serving area that is desired. A convenient length is one that would extend to somewhat beyond the wrist. Significantly longer lengths would tend to be unwieldy.

The support means may be of any shape or configuration that would conveniently conform with the underside of the lower arm or wrist. A concave shape, in the form of a half-cylinder is preferred because of the ability for one size to be adaptable for use of server's having different arm or wrist sizes. A V-shaped angle created by two planar surfaces would also be adequate for purposes of the invention. Either of the above configurations is amendable to stacking a plurality of trays and, thus, promotes the object of nestability.

The inclusions of legs such as depicted in FIG. 2 also materially enhances the ability to stack a plurality of trays and would eliminate the occurrence of a skewed stacking configuration. In addition, the use of legs is also preferred because the server could then place the tray on a flat surface without the danger of tilting. Moreover, the tray could then be easily picked up from such position with the use of only one hand. Of course, a single rectangular leg of a sufficient size to avoid tray tilting could be used instead of the above mentioned two legs.

Figure 3:
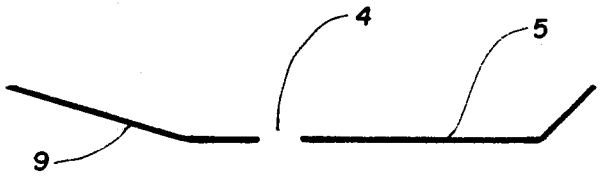
FIG. 3 is a schematical view of a serving tray section illustrating an angular support member that may be used in the serving tray of the invention.

It is also possible to provide a tray in accordance with the invention that is nestable and may be placed on generally flat surfaces without tilting that does not involve the use of legs. Such tray utilizes support means somewhat different than that previously described in that the support means do not extend below the bottom surface of the tray. Instead, the support means are located so as that at least a portion is generally on the same plane as the tray bottom or even slightly above the plane of the tray bottom. In either case, it may be advantageous to provide a slight upward, in relation to the top and bottom planar surfaces of the tray, angle or gradient so as to further assist in facilitating the thrusting action of the support means when the tray is carried at a level near the server's waist. FIG. 3 is a schematical view of a section of a serving tray similar to those depicted in FIGS. 1 and 2 which illustrates this concept, particularly the angular characteristic of the support member. Support member 9 may be located generally on the same plane or at a slight angle to tray surface 5. In use, the top portion of support means 9 is thrust up against the underside of the server's wrist and/or forearm upon insertion of the server's fingers into opening 4 as described previously. As would also be apparent from FIGS. 1 and 2, the opening may be located completely within the tray periphery, at its periphery or completely beyond its periphery and through the top and bottom surfaces of support means 9. It is preferred to locate opening 4 at or closely proximate to the tray periphery so as to maximize total tray serving area.

It is preferred to form the serving portion of the tray and the support means as a unitary structure. By integrally connecting the two structural portions of the invention, it is possible to realize a savings from the standpoint of assembly costs. However, the support means could also be detachable from the main portion of the tray if desired.

The tray may be made of any commonly available material such as wood, plastic, glass, metal, etc., provided that the material possesses sufficient rigidity to support the load.

I claim:

1. A serving tray, comprising:

a. a generally planar tray having a top and bottom surface and a periphery;

b. said tray having an opening extending through said top and bottom surfaces, said opening dimensioned so that at least a portion of a hand may be inserted through said opening so that fingers and at least a portion of a palm of the hand may serve to support said tray when the hand is positioned generally parallel to said tray; and c. support means connected with and generally parallel to said tray, extending beyond said periphery at least to as far as a wrist and below the bottom surface of said tray, and shaped so as to generally conform to the shape of the underside of the wrist.

2. A serving tray as claimed in claim 1, wherein:

said opening is located within an area bounded by said periphery.

3. A serving tray as claim 1, wherein:

said support means extend beyond said periphery for a distance greater than that of the wrist.

4. A serving tray as claimed in claim 1, wherein:

said support means comprise a generally half-cylindrical body.

5. A serving tray as claim 1, wherein:

said support means are an integral portion of said serving tray.

6. A serving tray as claimed in claim 1, wherein:

said serving tray is nestable with other like shaped serving trays.

7. A serving tray as claimed in claim 1 which further includes:

at least one leg connected to said tray bottom and extending below the bottom surface of the tray to a distance approximately equal to that of said support means.

8. A serving tray, comprising:

a. a generally planar tray having a top and bottom surface and a periphery;

b. support means having a top and bottom surface, connected with and generally parallel to said tray, extending beyond said periphery and below the bottom surface of said tray, and shaped so as to generally conform to the underside of a wrist; and c. said support means having an opening extending through said top and bottom surfaces of said support means, said opening dimensioned so that at least a portion of a hand may be inserted through said opening so that fingers and at least a portion of a palm of the hand may serve to support said tray when the hand is positioned generally parallel to said tray.

9. A serving tray, comprising:

a. a generally planar tray having a top and bottom surface and a periphery;

b. said tray having an opening extending through at least a portion of said top and bottom surfaces, said opening dimensioned so that at least a portion of a hand may be inserted through said opening so that fingers and at least a portion of a palm of the hand may serve to support said tray when the hand is positioned generally parallel to said tray; and c. support means connected with and generally parallel to said tray, extending beyond said periphery at least to as far as a wrist and located on substantially the same general plane as the bottom surface of said tray, and shaped so as to generally conform to the shape of the underside of the wrist for supporting said tray.

10. A serving tray as claimed in claim 9, wherein:

a portion of said support means being at a slight upward angle in relation to the top and bottom planar surfaces of the tray.

11. A serving tray, comprising:

a. a generally planar tray having a top and bottom surface and a periphery;

b. said tray having an opening extending through at least a portion of said top and bottom surfaces, said opening dimensioned so that at least a portion of a hand may be inserted through said opening so that fingers and at least a portion of a palm of the hand may serve to support said tray when the hand is positioned generally parallel to said tray; and c. support means connected with and generally parallel to said tray, extending beyond said periphery to as least as far as a wrist and located on a plane slightly above the general plane of the bottom surface of said tray, and shaped so as to generally conform to the shape of the underside of the wrist for supporting said tray.

12. A serving tray as claimed in claim 11, wherein:

a portion of said support means being at a slight upward angle in relation to the top and bottom planar surfaces of the tray.

13. A serving tray, comprising:

a. a generally planar tray having a top and bottom surface and a periphery;

b. support means having a top and bottom surface, connected with and generally parallel to said tray, extending beyond said periphery and located on substantially the same general plane as the bottom surface of said tray, and shaped so as to generally conform to the underside of a wrist; and c. said support means having an opening extending through said top and bottom surfaces of said support means, said opening dimensioned so that at least a portion of a hand may be inserted through said opening so that fingers and at least a portion of a palm of the hand may serve to support said tray when the hand is positioned generally parallel to said tray.

14. A serving tray as claimed in claim 13, wherein:

a portion of said support means being at a slight upward angle in relation to the top and bottom surfaces of the tray.

15. A serving tray, comprising:

a. a generally planar tray having a top and bottom surface and a periphery;

b. support means having a top and bottom surface, connected with and generally parallel to said tray, extending beyond said periphery and at least a portion of said support means located slightly above the general plane of the bottom surface of said tray, and shaped so as to generally conform to the underside of a wrist; and c. said support means having an opening extending through said top and bottom surfaces of said support means, said opening dimensioned so that at least a portion of a hand may be inserted through said opening so that fingers and at least a portion of a palm of the hand may serve to support said tray when the hand is positioned generally parallel to said tray.

16. A serving tray as claimed in claim 15, wherein:

a portion of said support means being at a slight upward angle in relation to the top and bottom surfaces of the tray.

* * * * *